United States Patent [19]

Stevenson, Jr.

[11] 4,091,537

[45] May 30, 1978

[54] SAFETY UTILITY KNIFE

[75] Inventor: Wayne E. Stevenson, Jr., Mechanicsburg, Pa.

[73] Assignee: Stevenson Machine Shop, Mechanicsburg, Pa.

[21] Appl. No.: 790,960

[22] Filed: Apr. 26, 1977

[51] Int. Cl.[2] ..... B26B 29/00

[52] U.S. Cl. ..... 30/286; 30/151; 30/293; 30/294

[58] Field of Search ..... 30/286, 289, 294, 293, 30/151

[56] References Cited

U.S. PATENT DOCUMENTS

| | | | |
|---|---|---|---|
| 142,942 | 9/1873 | Ratelle | 30/289 |
| 705,441 | 7/1902 | Putney | 30/162 |
| 1,813,868 | 7/1931 | Smiroldo | 30/294 |
| 2,293,892 | 8/1942 | Evinger | 30/286 |
| 2,644,230 | 7/1953 | Anderson | 30/151 |
| 2,784,489 | 3/1957 | Reise | 30/151 |
| 2,788,574 | 4/1957 | Marcmann | 30/320 |
| 3,943,627 | 3/1976 | Stanley | 30/151 |

FOREIGN PATENT DOCUMENTS

| | | | |
|---|---|---|---|
| 161,629 | 3/1955 | Australia | 30/294 |

*Primary Examiner*—James L. Jones, Jr.
*Assistant Examiner*—J. T. Zatarga
*Attorney, Agent, or Firm*—Samuel M. Learned, Jr.

[57] ABSTRACT

A hand-held safety utility knife having an elongated shaped handle within which a replaceable cutting blade is securely retained, wherein the knife assembly is also provided with a compression-extension spiral spring loaded retractable blade guard that is mechanically cooperative with the cutting blade of the knife and manually activated for retraction by depressing a compression-extension spiral spring loaded trigger thereby enabling cutting utility of the blade in use application, and upon manual trigger release after use application provides non-use safety locking of the guard with respect to the utility knife cutting blade.

10 Claims, 6 Drawing Figures

SAFETY UTILITY KNIFE

BACKGROUND OF THE INVENTION

The present invention discloses a hand-held cutting device of that type generally employed in use applications such as carton opening and the like, wherein said device of the instant invention is provided with a new and improved blade guard means, the combined mechanical features thereof being hereinafter referred to and defined as a "safety utility knife", the same of which is more specifically comprised of a shaped handle having a replaceable blade statically positioned and secured therein, said blade being mechanically cooperative with a compression-extension spiral spring loaded blade guard in such a manner whereby after manually operable trigger depression of a compression-extension spiral spring loaded blade guard release means there is in turn enabled spring compression retraction of said blade guard into said handle upon use application of said knife, thereby exposing said blade for cutting operation, wherein said blade guard thereafter automatically extends upon completion of use application and safety locks upon manual trigger release by way of extension of the multiply acting compressed spiral spring forces aforementioned, to thereby mechanically cause said blade guard to assume a non-use safety configuration position relative to said blade.

In general, the prior art hand-held safety utility knife cutting device disclosures are comprised of the following major types. First, being those similar in some respects to the instant invention by virtue of having a shaped handle means provided with a statically positioned and retained cutting blade assembled therein, in the first instance having blade guard means being manually operable from an extended safe configuration to a retracted blade exposed working position as exemplified by that safety utility knife taught in U.S. Pat. No. 2,784,489 to Reise, dated Mar. 12, 1957. Or, in the second instance, as taught in U.S. Pat. No. 2,644,230 to Anderson, dated July 7, 1953, disclosing a hand-held safety utility knife provided with a trigger released retractable blade guard operable by the embodiment of a modified torsion spring means.

A second general type of hand-held safety utility knife cutting device disclosure, embodying the incorporation of spring means, is exemplified by that as taught in U.S. Pat. No. 2,743,523 to Honey, dated May 1, 1956, wherein the blade guard per se is comprised of a shaped deformable band spring provided with a slotted opening through which one corner of the cutting blade projects when pressure is applied to the knife to cause cutting of the surface to be severed.

A third general type of hand-held safety utility knife cutting device having spring activated blade guard means is also taught, exemplary of which would be those such as respectively shown in U.S. Pat. No. 1,222,366 to Curry, dated Apr. 10, 1917, U.S. Pat. No. 2,376,887 to Walters, dated May 29, 1945, and U.S. Pat. No. 2,730,800 to Bailey, dated Jan. 17, 1956, wherein the protective blade guard means are all operable from a safe blade encasing to a retracted blade exposed working position by overcoming the resistive force of a torsion spring means when use application pressure is imparted to the knife to cause cutting of the surface to be severed.

Collaterally, compression-extension spiral spring loaded blade guards for cutting devices other than those which would be classed as safety utility knives are also disclosed by certain prior art teachings, exemplary among those of which would be U.S. Pat. No. 390,759 to DeLamarre, dated Oct. 9, 1888, wherein an oyster knife is provided with a compression-extension spiral spring loaded blade end guard assembled to two detented rod guides and having user rotatable ring means on the knife handle thereof to lock said blade end guard in a spring compressed retracted position and afterwards release it therefrom. The disclosure set forth in U.S. Pat. No. 1,181,681 to Nicaud, dated May 2, 1916, teaches a dagger having a cylindrical pointed-rod type blade being provided with a compression-extension spiral spring loaded tubular sheath which retracts annularly into the handle of said dagger upon use impact compression of said spring and extends to the safe blade encasing position upon release, while in U.S. Pat. No. 2,512,237 to Mravik, dated June 20, 1950, there is taught a similar compression-extension spiral spring loaded annularly retractable blade sheath for a pocket pen type of knife. In. U.S. Pat. No. 2,882,598 to Fidelman, dated Apr. 21, 1959, there is disclosed a compression-extension spiral spring loaded telescopic sleeve comprising a combined blade guard and work guide means for an envelope opener.

It should be understood that some of the features of the instant invention have, in some respects, certain structural and functional similarities to teachings separately set forth in the prior art disclosures heretofore cited and briefly discussed. However, as will hereinafter be pointed out, the instant invention is distinguishable from said earlier inventions in one or more ways in that the present invention has utility features and new and useful advantages, applications, and improvements in the art of safety utility knives not heretofore known.

SUMMARY OF THE INVENTION

It is the principal object of the present invention to provide a hand-held safety utility knife comprised of an elongated two-piece shaped handle assembly which may be separably disassembled for purposes of installing a new replaceable cutting blade or reversibly changing the cutting edge end thereof, wherein said knife embodies the further features of incorporating a spiral spring loaded retractable blade guard which mechanically cooperates in combination with a manually operable spiral spring loaded blade guard release and lock trigger whereby the non-use position of said blade guard is that of being in an extended safety locked configuration relative to the cutting edge of said blade, which blade guard, however, upon manual trigger depression and simultaneous application of manually imparted pressure directed by means of said knife handle towards and upon the surface to be severed mechanically causes said blade guard to retract against compressive spring force into said handle assembly and thereby expose the blade cutting edge for use application in severing service.

It is another object of the present invention to provide a safety utility knife embodying a retractable blade guard as aforedescribed wherein the same does not lock in the retracted blade exposed use position but rather automatically extends to the safety locked non-use position upon withdrawal of manually imparted use application pressure and trigger release.

It is a further object of the present invention to provide a safety utility knife as previously described which is only functionally operable in use application employment by way of the multiple manually initiated cooperative mechanical features thereof in combination.

Still another object of the present invention is to provide a safety utility knife wherein the elongated shaped handle thereof provides a firm and comfortable dimensional gripping surface when said knife is employed in heavy duty hand-held cutting use applications.

It is also an object of the present invention to provide a safety utility knife which is durable, simple in construction, and inexpensive to manufacture.

DETAILED DESCRIPTION OF THE INVENTION

Figure 1:
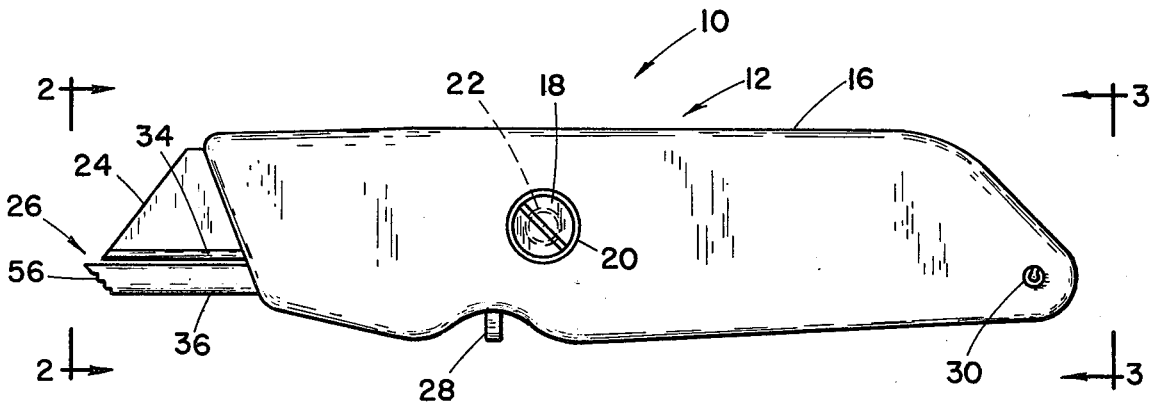
FIG. 1 is a side elevation of the safety utility knife comprising the instant invention.
Figure 3:
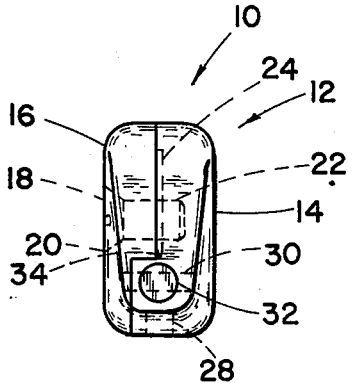
FIG. 3 is a rear end elevation of the safety utility knife shown in FIG. 1 as seen along the line 3 — 3 thereof.
Figure 4:
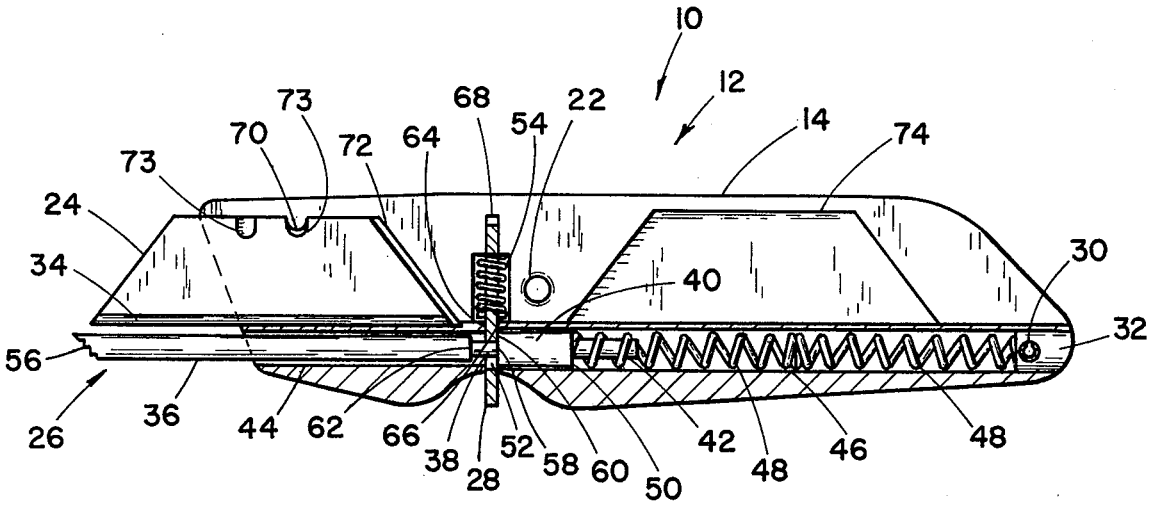
FIG. 4 is a side elevation of the safety utility knife comprising the instant invention showing the respective working mechanism configurations thereof when the blade guard is in an extended safety locked position as illustrated in FIG. 2 and seen along the line 4 — 4 thereof.

Referring to FIG. 1, the present invention which comprises a hand-held safety utility knife 10 is shown in a side elevation view, the same having an elongated shaped two-piece handle 12 (as more clearly shown in FIG. 2) being a blade guard retaining member 14 (not shown per se in FIG. 1 but illustrated in FIG. 2 and certain subsequent Figures) and a cover member 16 compressively joined one to the other by a screw 18 which is inserted through an opening 20 in said cover member and threadably engaged within a threaded opening 22 in said blade guard retaining member whereby a replaceable cutting blade 24 is securely retained within said handle, and a spiral spring loaded retractable blade guard 26 which is operable from the extended safety locked position as shown (and as also shown in FIG. 4), to the retracted blade exposed utility cutting position (as respectively shown in FIG. 5 and FIG. 6), by means of manually depressing a spiral spring loaded blade guard release and lock trigger 28 thereby enabling retractable blade guard compression of the blade guard spiral spring means upon use application pressure being manually imparted to said knife to also thereby cause cutting of the surface to be severed. Additionally shown in FIG. 1 is a spring pin 30 inserted through the butt end of said handle to provide that means by which the blade guard compression-extension spiral spring retaining plug 32 (not shown in FIG. 1, but illustrated in FIG. 3 and certain subsequent Figures) is held in position in said handle.

As also shown in FIG. 1, the shaped handle 12 of said safety utility knife 10 is configured to comfortably enable hand-held manual use employment, plus also provide a sufficient handle means and mass to enable a firm dimensional gripping surface during heavy duty hand-held cutting use applications. It will further be noted that in the knife 10 safety lock position the retractable blade guard 26 is, by mechanical means to be more fully hereinafter described, secured in an extended configuration relative to providing accidental cutting protection from the blade cutting edge 34 of said replaceable cutting blade 24. Also, as will more fully be hereinafter described, by removal of the screw 18 the respective two-piece handle members 14 and 16 may thereupon be separated one from the other and the cutting blade 24 made accessible for either reversed cutting end changing or replacement.

The safety utility knife 10 as herein disclosed and described is preferably cast-constructed from metal, however, any other suitable materials or combinations thereof may be used.

Figure 2:
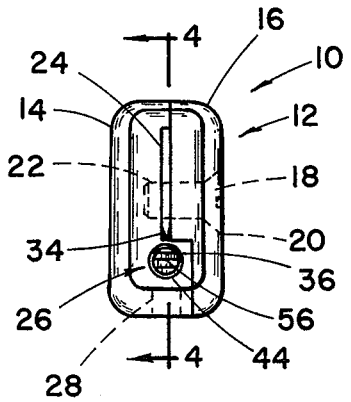
FIG. 2 is a front end elevation of the safety utility knife shown in FIG. 1 as seen along the line 2 — 2 thereof.

Referring now to FIG. 2, wherein there is shown a front end elevation and the relative assembly relationship of the component elements of the safety utility knife 10 as illustrated in FIG. 1, wherein also it is to be particularly pointed out that the shape of the retractable blade guard 26 is that of an elongated cylindrical rod.

The view shown in FIG. 3 is a rear end elevation of the safety utility knife 10 as illustrated in FIG. 1, and wherein also it is to be particularly pointed out that the shape of the blade guard compression-extension spiral spring retaining plug 32 is that of a cylindrical rod segment.

In FIG. 4 a side sectional elevation of the safety utility knife 10 working mechanism configurations with the retractable blade guard 26 in the extended safety locked position is shown, in addition to other features of said safety utility knife 10 not heretofore described.

Considering first the retractable blade guard 26, which is comprised of a single piece, but, however, having four intergal axially aligned longitudinally disposed cylindrical rod sections of different abutting cross-sectional dimension, being the blade guard per se 36, the trigger catch 38, the compression-extension spiral spring retaining collar 40, and the compression-extension spiral spring guide 42. The blade guard per se 36 is slidably assembled in the retaining member tubular blade guard guide opening 44, said opening being of slightly larger diameter than said blade guard per se 36, thereby enabling the blade guard per se 36 to freely guidably slide reciprocally therein during use application of said safety utility knife 10. The trigger catch 38 is a relatively short rod section of smaller cross-sectional diameter than the blade guard per se 36, disposed intermediate of said blade guard per se and the compression-extension spiral spring retaining collar 40 which is a rod section of larger cross-sectional diameter than the blade guard per se 36 and longitudinally shorter than the same, but longitudinally longer than the trigger catch 38. The above-described cross-sectional dimension configuration of the retractable blade guard 26 therefore provides collar stops at the respective longitudinal ends of said trigger catch 38, which function in manually operable mechanical cooperation with the blade guard release and lock trigger 28 in the manner to be later hereinafter described.

The compression-extension spiral spring retaining collar 40 is slidably assembled in the retaining member blade guard compression-extension spiral spring tubular opening 46 which is of a slightly larger diameter than said spring retaining collar 40 and thereby enables the same to freely guidably slide reciprocally therein against the compressive and extensive forces of the dual blade guard compression-extension spiral springs 48 tandemly assembled also slidably within said spiral spring tubular opening 46 in compression respectively against the retaining collar butt end stop surface 50 at the safety utility knife blade end and against the spiral spring retaining plug 32 at the safety utility knife butt end. Inserted axially within the spiral opening of the safety utility knife blade end tandemly assembled blade guard compression-extension spiral spring 48 is the compression-extension spiral spring guide 42 of the retractable blade guard 26. It is the above-described blade guard and compression-extension spiral spring assembly combination which provides the retractable blade guard features of the safety utility knife 10 in use application and the extendible blade guard features thereof when in non-use.

Manually operable in mechanical cooperation with the blade guard compression-extension spiral spring assembly combination is the blade guard release and lock trigger 28. It will be noted that said trigger 28 is provided with a blade guard trigger opening 52 therein, and is reciprocally operable perpendicular to said retractable blade guard 26 by means of manual finger depression against the compressive force of the trigger assembly compression-extension spiral spring 54. The trigger opening 52 is circular in configuration and also of a slightly larger diameter than said blade guard per se 36, so that when said safety utility knife 10 is employed in hand-held use application with the angled blade guard serrated tip 56 applied in compressive frictionally engaged force against a surface to be severed, and the blade guard release and lock trigger 28 manually depressed against the trigger assembly compression-extension spiral spring 54 compressive force to that point where the blade guard per se 36 and the blade guard trigger opening 52 are in axial alignment, said blade guard per se 36 will then be forced to slidably retract against the compressive force of the blade guard compression-extension spiral springs 48 and thereby expose the blade cutting edge 34 of the replaceable cutting blade 24 for severing service in the retracted blade exposed utility cutting position. In the blade guard extended safety locked position as shown in FIG. 4, however, the trigger 28 is urged outward by the extension force of the trigger assembly compression-extension spiral spring 54 so that the inward radial surface of the blade guard trigger opening 52 compressively engages the inward surface of the trigger catch 38, while simultaneously the retaining collar blade end stop surface 58, being of a larger diameter than the blade guard trigger opening 52, compressively engages the butt end trigger surface 60 of said trigger 28 under the combined tandem extension forces of the blade guard compression-extension spiral springs 48, and thereby causes said blade guard per se 36 to be extended to the blade guard safety position. The blade guard safety lock feature is provided by the blade guard butt end collar 62, whereby, in the event of an inadvertent compressive force application to the angled blade guard serrated tip 56 said blade guard butt end collar 62 will be engaged by the blade end trigger surface 64 and retractable movement of the blade guard per se 36 will thereby be mechanically stopped prior to exposing the blade cutting edge 34 of said replaceable cutting blade 24.

It should be noted that the trigger assembly compression-extension spiral spring 54 is retained in operable compressive position upon the trigger 28 by the spring retaining pin 66, and upon manual depression of said trigger 28 the inward end thereof retracts into the trigger recess 68.

Additionally shown in FIG. 4 is the cutting blade positioning lug 70 and the cutting blade retaining recess 72, both of which are cast formed as parts of the blade guard retaining member 14, and respectively serve to position and engage a cutting blade 24 by means of one of a plurality of positioning detents 73 therein between the two-piece handle members 14 and 16 when a cutting blade is reversed or replaced by removing screw 18. Also shown is the spare blade storage recess 74, likewise cast formed in the blade guard retaining member 14, wherein a spare replacement cutting blade may be conveniently stored.

Figure 5:
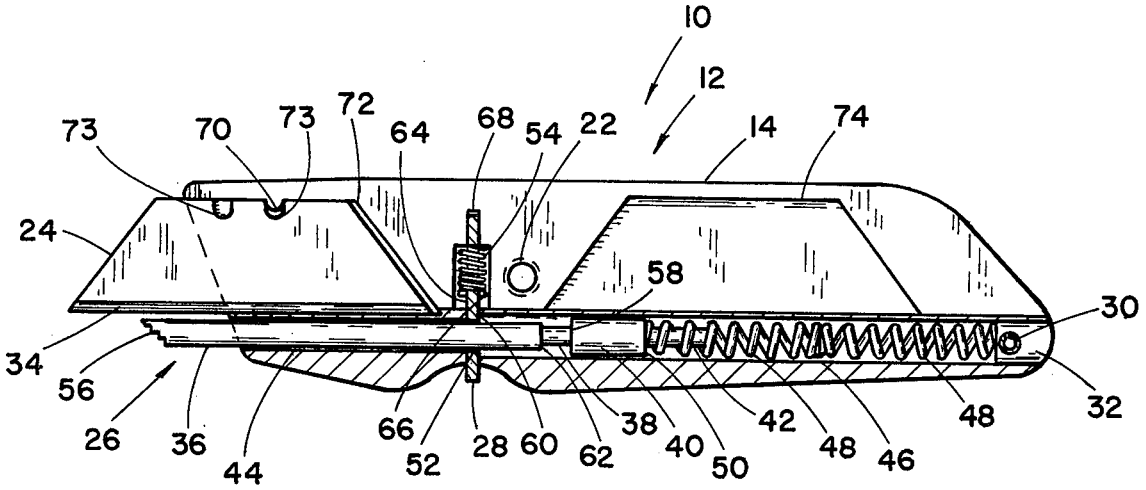
FIG. 5 is a similar side elevation of the safety utility knife comprising the instant invention as seen in FIG. 4, showing however, the respective working mechanism configurations thereof when the blade guard is in a retracted use application position.

The illustration shown in FIG. 5 is similar to that as seen in FIG. 4, except the mechanically cooperative mechanisms of the safety utility knife 10 as previously described are respectively shown in those configurations as would be seen when the blade guard release and lock trigger 28 is manually depressed and the blade guard per se 36 is retracted through the blade guard trigger opening 52 against compressive force of the blade guard compression-extension spiral springs 48, thereby exposing the blade cutting edge 34 of the replaceable cutting blade 24 for severing service.

Figure 6:
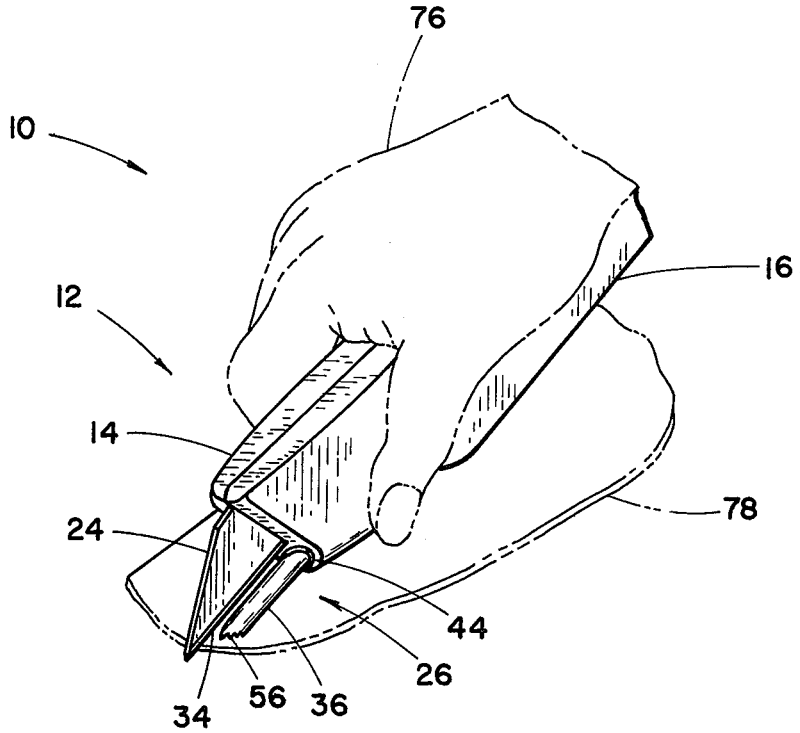
FIG. 6 is a perspective front angle elevation of the safety utility knife comprising the instant invention showing the same in an exemplary use application cutting position.

In FIG. 6 there is seen a typical safety utility knife 10 hand-held manual use application illustration, wherein said knife 10 is firmly gripped in the typical user's hand 76, and with the blade guard release and lock trigger 28 (not shown) being held in the depressed position, and with the angled blade guard serrated tip 56 manually held in frictionally engaged compressive force against a typical surface to be severed 78, the blade guard per se 36 is thereby retracted to expose the blade cutting edge 34 of the replaceable cutting blade 24 for severing service.

Although the invention has been herein shown and described in what is conceived to be the most practical and preferred embodiment, it is recognized that departures may be made therefrom within the scope of the invention, which is not to be limited to the details disclosed herein but is to be accorded the full scope of the claims so as to embrace any and all equivalent devices and apparatus.

I claim:

1. A safety utility knife comprised of a separable elongated shaped two-piece handle adapted to positionally secure and retain therein a replaceable cutting blade having a cutting edge said two-piece handle also being further provided with a spare cutting blade storage recess therein, which is old, characterized by:

(a). an elongated geometrically configured spiral spring activated retractable blade guard cutting edge rod member provided with an insertably assembled first compression-extension spiral spring to movably communicate compressive and extensive coaction therewith, said rod member in the extended position being adjacently, downwardly disposed with respect to and in the same general plane as said cutting edge, said rod member having an inner end within the handle with a shoulder adjacent said inner end, (b). a mechanically cooperative geometrically configured spiral spring activated blade guard cutting edge rod member release and lock trigger provided with an insertably assembled second compression-extension spiral spring to movably communicate compressive and extensive coaction therewith, and (c). a manually initiated mechanically cooperative alignment coaction between said elongated geometrically configured spiral spring activated retractable blade guard cutting edge rod member and said geometrically configured spiral spring activated blade guard cutting edge rod member release and lock trigger to enable retraction of said blade guard cutting edge rod member through an opening in said blade guard cutting edge rod member release and lock trigger into a longitudinally disposed axially aligned first spiral spring tubular opening within said handle against the coactive compressive force of said first spiral spring retained therein to thereby expose the cutting edge of said cutting blade for severing service upon a manually imparted finger-force depression of said blade guard cutting edge rod member release and lock trigger against the coactive compressive force of said second spiral spring when said knife is employed in combination with a concurrent manually imparted use application pressure directed by way of said handle towards a surface to be severed, wherein, following which, upon release of said manually imparted use application pressure to said handle, said manually initiated mechanically cooperative alignment coaction being coactively cooperative reversely thereby enables automatic extension of said blade guard cutting edge rod member outwardly of said longitudinally disposed axially aligned first spiral spring tubular opening through said opening in said blade guard cutting edge rod member release and lock trigger under the coactive extensive force of said first spiral spring to position said blade guard cutting edge rod member in protective cover of the cutting edge of said cutting blade, and upon a subsequent release of said manually imparted finger-force depression upon said blade guard cutting edge rod member release and lock trigger thereby also enables said blade guard cutting edge rod member release and lock trigger to automatically extend under the coactive extensive force of said second spiral spring and thereupon cause a positive mechanical engagement locking of said blade guard cutting edge rod member by means of said trigger opening engaging said shoulder on said rod member in a close proximity downwardly disposed longitudinally extended position relative to and guardably protective of said cutting edge of said cutting blade.

2. The safety utility knife according to claim 1 in which said blade guard cutting edge rod member has a longitudinally disposed outward terminal end provided with a serrated tip.

3. The safety utility knife according to claim 2 in which said serrated tip is positioned at an angle relative to the longitudinal axis of said blade guard cutting edge rod member.

4. The safety utility knife according to claim 3 in which said angle is between 0 and 90°.

5. The safety utility knife according to claim 4 in which said angle is 45°.

6. The safety utility knife according to claim 1 in which said elongated geometrically configured spiral spring activated retractable blade guard cutting edge rod member is comprised of a plurality of integrally communicating longitudinally disposed cylindrical rod sections of different but respectively uniform cross-sectional diameter dimension throughout.

7. The safety utility knife according to claim 6 in which said plurality of integrally communicating longitudinally disposed cylindrical rod sections are in turn respectively of different longitudinal dimension.

8. The safety utility knife according to claim 6 in which a first longitudinal section, being a blade guard per se, has a first cross-sectional diameter; a second longitudinal section, being a trigger catch adjacent said shoulder has a second cross-sectional diameter which is less than but at least half of that of said first cross-sectional diameter; a third longitudinal section, being a first compression-extension spiral spring retaining collar, has a third cross-sectional diameter which is greater than but less than twice of that of said first cross-sectional diameter; and a fourth longitudinal section, being a first compression-extension spiral spring guide, has a fourth cross-sectional diameter which is less than said first cross-sectional diameter but greater than said second cross-sectional diameter.

9. The safety utility knife according to claim 8 in which said blade guard per se has a first longitudinal dimension which is greater than twice that of said trigger catch the same comprising a second longitudinal dimension, wherein a third longitudinal dimension, being that of said first compression-extension spiral spring retaining collar, is more than twice that of said trigger catch but less than half that of said blade guard per se, and a fourth longitudinal dimension, being that of said first compression-extension spiral spring guide, being the same as that of said first compression-extension spiral spring retaining collar.

10. The safety utility knife according to claim 1 in which said blade guard cutting edge rod member release and lock trigger opening is circular having a diameter which is greater than that of the cross-sectional diameter of said blade guard per se thereby coactively enabling said blade guard per se to retractively and extensively communicate therethrough upon alignment coaction therewith, but less than that of the cross-sectional diameter of said first compression-extension spiral spring retaining collar thereby coactively restricting communication thereof therethrough.

* * * * *